United States Patent [19]

Ring

[11] Patent Number: 4,642,432

[45] Date of Patent: Feb. 10, 1987

[54] SWITCH MECHANISM WITH COMBINATION SPRING AND ASSEMBLY RETAINER

[75] Inventor: Thomas F. Ring, Shelby, N.C.

[73] Assignee: Fasco Controls Corporation, Sheslby, N.C.

[21] Appl. No.: 810,582

[22] Filed: Dec. 19, 1985

[51] Int. Cl.[4] ..... H01H 21/38

[52] U.S. Cl. ..... 200/155 R; 200/336; 200/303; 200/260; 200/290; 200/11 J

[58] Field of Search ..... 200/155 R, 303, 252, 200/260, 290, 336, 11 R, 11 A, 11 D, 11 J; 24/510

[56] References Cited

U.S. PATENT DOCUMENTS

| | | | |
|---|---|---|---|
| 2,680,383 | 6/1954 | Lahti | 200/336 X |
| 3,110,774 | 11/1963 | Krol et al. | 200/155 R |
| 3,157,756 | 11/1964 | Close et al. | 200/61.7 |
| 3,892,931 | 7/1975 | Lockard | 200/11 R |

FOREIGN PATENT DOCUMENTS

| | | | |
|---|---|---|---|
| 579672 | 6/1933 | Fed. Rep. of Germany | 200/155 R |
| 696459 | 4/1940 | Fed. Rep. of Germany | 200/155 R |
| 957297 | 9/1982 | U.S.S.R. | 200/155 R |

*Primary Examiner*—Henry K. Artis
*Assistant Examiner*—Ernest G. Cusick
*Attorney, Agent, or Firm*—Fitzsimmons, Shlesinger Shlesinger

[57] ABSTRACT

A switch mechanism is disclosed as including a body member containing the switching elements for an electrical circuit and a rotary external actuator for producing corresponding rotary motion to the switching elements for placing the switch mechanism into its controlling conditions. The actuator is held in a restrained position upon the body member and also resiliently biased into a controlling condition by a single element, a coil spring.

9 Claims, 4 Drawing Figures

SWITCH MECHANISM WITH COMBINATION SPRING AND ASSEMBLY RETAINER

BACKGROUND OF THE INVENTION

The present invention relates to switch mechanisms particularly adapted for use in passive restraint seatbelt systems in automobiles and other vehicles.

The number of seating positions for all sizes of automobiles can vary between four and six, each being provided with seatbelts, and for some positions, shoulder restraining belts and related equipment. Part of this equipment includes electrical switches in circuits which are utilized to warn occupants that their seatbelts are not connected and/or in use, or as an interlock device which is adapted to inhibit operation of an automobile unless all occupied seats have their respective seatbelts connected. Interlock systems may also be connected to automobile doors and to an alarm system for warning the driver or passengers.

The presence of seatbelts, the attendant electrical circuits and switches therefor, and interlock structure for each of the seating positions of an automobile has increased the cost of automobiles for the manufacturer and consequently, to the ultimate purchaser. As is well appreciated, the automobile industry is the most competitive market in the world today with the industry turning out millions of automobiles every year along with the many replacement parts therefor.

Because of their highly competitive activity, it is incumbent upon manufactureres to carefully analyze and review the design and cost of each of the thousands of parts and components which go into the finished automobile. Generally no item is overlooked in these investigations, and every chance is taken to achieve a competitive edge by simplifying, redesigning and utilizing cost effective procedures to bring down the unit manufacturing cost of the automobile.

In the case of seatbelt safety systems, one area of design which can be costly is in the provision and use of electrical switches. In the case of the need for four to six seatbelt mechanisms per car, there would be a corresponding need for four to six switching mechanisms for the safety alarm or for any other systems which may inhibit automobile operation if such were intended. A thorough costing investigation, therefore, would include a study of the switching mechanisms in order to achieve low cost items for this purpose. In achieving low cost, however, it must be remembered that such a goal must be accomplished without detracting whatsoever from the efficiency, the dependability, and the life span of the switching mechanism while still maintaining the safety precautions these items were designed to provide.

Another consideration the manufacturer must bear in mind during design study of seatbelt systems and safety switches is the need to consider the particular environment for switch mechanisms associated with seatbelt systems. The life span of the conventional car takes it through periods of extremes in weather: very hot and humid to very cold and dry. The life span will also include hundreds of hours of driving in heavy rain and snowstorms when switching mechanism become wet and exposed to moisture condensation. In addition, during the many miles of the life span of the car, the slow buildup of dust and contaminants is ever prevailing and damaging with such dust and contaminants working their way through the very fine spacing between switching parts and related structure to cause eventual failure of the switching mechanisms.

SUMMARY OF THE INVENTION

In the present invention, a switch mechanism is devised as having a plastic molded body member formed with two connected body sections, one section containing two fixed contact plates. A movable switch element is mounted within the other section of the body member andis spring biased against the contact plates. Another molded plastic member having a switching actuator element is attachably secured to the body member, being rotatably held thereon by a coil spring which serves in the dual role as a means for retaining the members in an assembled arrangement and to bias the rotation of the actuator member relative to the body member.

The switching element is secured to the actuator member to be rotatably movable therewith. The coil spring is constructed and arranged relative to the two members so so that, when flexed in the radial direction and embedded into the body members,t he spring will secure the members together as an assembled mechanism and still provide spring biased rotary movement of the actuator member relative to the body member.

Therefore, it is the principal object of the present invention to minimize the number of parts in a switching mechanism used on interlocking electrical circuits in seatbelt safety systems.

Another object of the invention is to simplify the design of switching mechanisms used in seatbelt safety systems to a minimum of moving parts, all of which are of a low cost nature.

Still another object of the invention is to utilize a switching mechanism having parts designed and arranged to withstand extreme environmental conditions and to retain operative dependability for a relatively long life span.

Other objects and advantages will become apparent after reading the specification below taken in conjunction with the accompanying drawings wherein:

THE DRAWINGS

DETAILED DESCRIPTION OF THE PREFERRED EMBODIMENT

Figure 1:
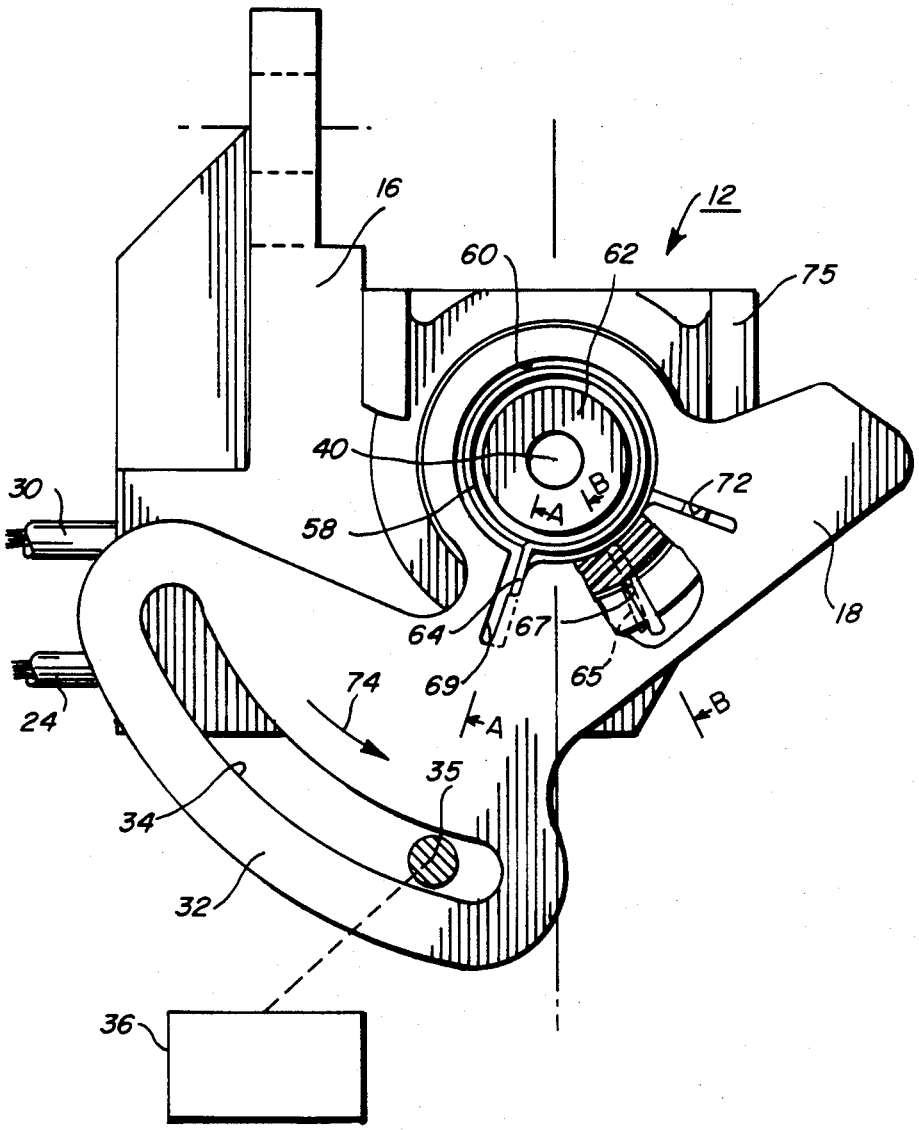
FIG. 1 is a plan view of the switching mechanism arranged in accordance with the present invention.
Figure 2:
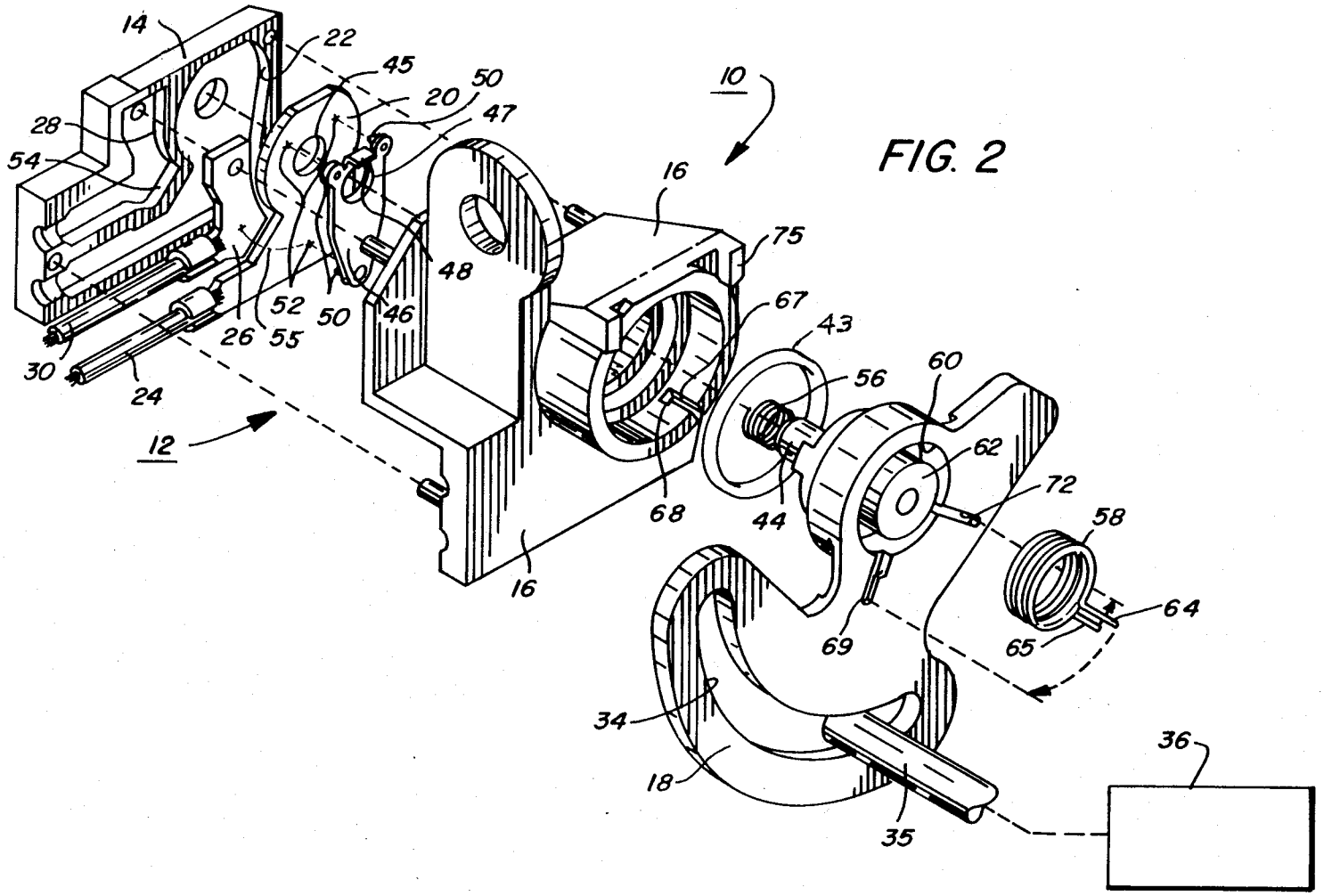
FIG. 2 is an exploded isometric view of the switching mechanism.

As shown in FIGS. 1 and 2, the switching mechanism, as derived in accordance with the present invention, is generally indicated by the reference numeral 10. The mechanism includes a plastic molded main body member 12 having sections 14 and 16 permanently secured to each other when assembled, and a plastic molded actuator member 18, the latter being mounted for rotation relative to the body member 12 by an arrangement to be described below.

The body member 12 includes a metallic switching plate 20 secured within a recess 22 formed in the section 14 and electrically connected to an electrical conductor 24 held between the sections 14, 16 when joined together. A second metallic switching plate 26, spaced from the plate 20, is retained within a recess 28 formed in the section 14 and is electrically connected to a conductor 30 also held between the sections 14, 16. The conductors 24, 30 are suitably connected in an electrical circuit which may form part of a passive restraint seatbelt system for an automobile or other vehicle. The present invention is adapted to connect the switching plates 20 and 26 which lie in the same plane within the section 14 electrically in service relative to the conductors 24, 30 thereby serving as an ON-OFF switching mechanism for the seatbelt safety system.

The actuator 18 is formed with an outwardly projecting planar portion 32 having a curved slot 34 formed therein for detachably and adjustably receiving an actuator element 35 connected to a vehicle door lock mechanism 36, or the like. At the other end of the actuator, a hollow cylindrical portion 38 is formed having its axis 40 generally perpendicular to the plane of the projecting portion 32. This cylindrical portion is received in a conforming opening 42 formed in the section 16 of the body member 12. An O-ring 43 between the outer wall of the portion 38 and the opening 42 seals the interior of the body member.

Extending along the axis 40, a solid cylindrical projection 44 extends beyond the end of the portion 38 which is concentric therewith and through an opening formed in the plate 20. A suitable conforming recess 45 in the section 14 accommodates the end of the projection and also serves to anchor the adjacent structure of the actuator 18 against motions radially of the axis 40.

Within the body member 12, metallic switching element 46 is arranged for bridging over and causing electrical contact between two contact plates 20, 26 when moved to one operating position and electrically to disconnect these plates when moved into another operating position. This operation is accomplished by the operative connections of the switching element 46 to the actuator 18. The element 46 is generally triangular in shape and is formed with an opening 47, adjacent one of the apexes thereof, through which the projection 44 freely extends. At this same apex, a tang 48 is formed along the adjacent edge and is bent penpendicular to the plane of the element. The tang 48 extends into a short, arcuate slot 49 formed in the outer end of the cylindrical portion 38 and is adapted to receive the end of the tang 48 when the switching mechanism 10 is assembled.

As shown in FIG. 2, the actuator 18 is rotatable about the axis 40, and when rotated, causes the slot 49 to move in an arc about this axis. With the length of the slot 49 being short, the tang 48 will engage either of the ends of the slot depending upon the direction of rotation of the actuator 18. When the tang reaches an end of the slot, it is carried along by continued rotation of the actuator thereby causing rotation of the switching element 46 about the axis 40 and causing the same electrically to connect or disconnect plates 20 and 26 depending upon the direction of rotation.

The switching element 46 is formed with dimples 50, one at each apex facing the contact plates 20, 26. In one controlling position of the actuator 18, all three of the dimples 50 are in contact with the contact plate 20, as illustrated in FIG. 2 by the numeral 52 at the points of contact. In this position, there is no electrical connection between the conductors 24, 30. In the other controlling position for the actuator 18, wherein rotation has caused the switching element to be rotated about the axis 40, the lower most dimple 50 being farthest from the axis will have been moved in a relatively large arc. In so moving, the lower dimple will jump across a partition 54 of plastic molded material which insulatingly separates the plates 20, 26 and will come in electrical contact with the contact plate 26, as illustrated by the dotted line 55. In this manner, electrical contact is established between the conductors 24, 30. A coil spring 56 encircling the projection 44 and held in compression within the portion 38 serves to maintain a bias upon the element 46 against the plates 20, 26 thereby insuring adequate electrical engagement of these parts.

Means are provided which resiliently biases the rotation of the actuator 18 about the axis 40 to one controlling position and permit counter-rotation against this bias to another controlling position, and which hold the actuator in its assembled condition with the switching mechanism 10. This dual function is achieved by a coil spring 58 and the arrangement of mounting the same within the switching mechanism.

Figure 3:
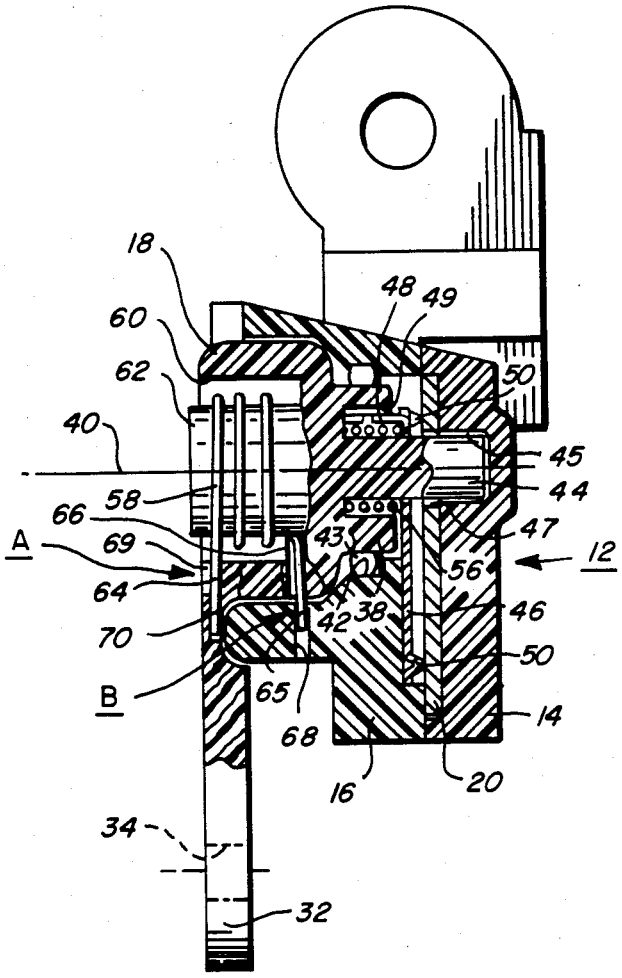
FIG. 3 is a cross-sectional view of the switching mechanism with parts broken away along lines A—A and B—B in FIG. 1.

The coil spring 58 is mounted within a conforming circular opening 60 formed in the actuator 18 and encircles a cylindrical portion 62 of the actuator. The opening 60 and the portion 62 are concentric about the axis 40 which, as previously stated, is the common axis for both the portion 38 and the projection 44. Each end of the spring 58 terminates in a straight end section: the upper end of the spring, as viewed in FIG. 3 indicated by the numeral 64, and the lower end indicated by the reference numeral 65. Normally, in its unstressed condition of the spring 58, the ends 64, 65 are generally axially aligned. When assembled in the switch mechanism 10, the ends 64, 65 are disposed at a significant radial angle relative to each other and anchored: the end 64 to the actuator 18, and the end 65 to the body member 12. In this manner, the spring will be under torsional stress causing a continuous resilient bias upon the actuator relative to the body member.

Figure 4:
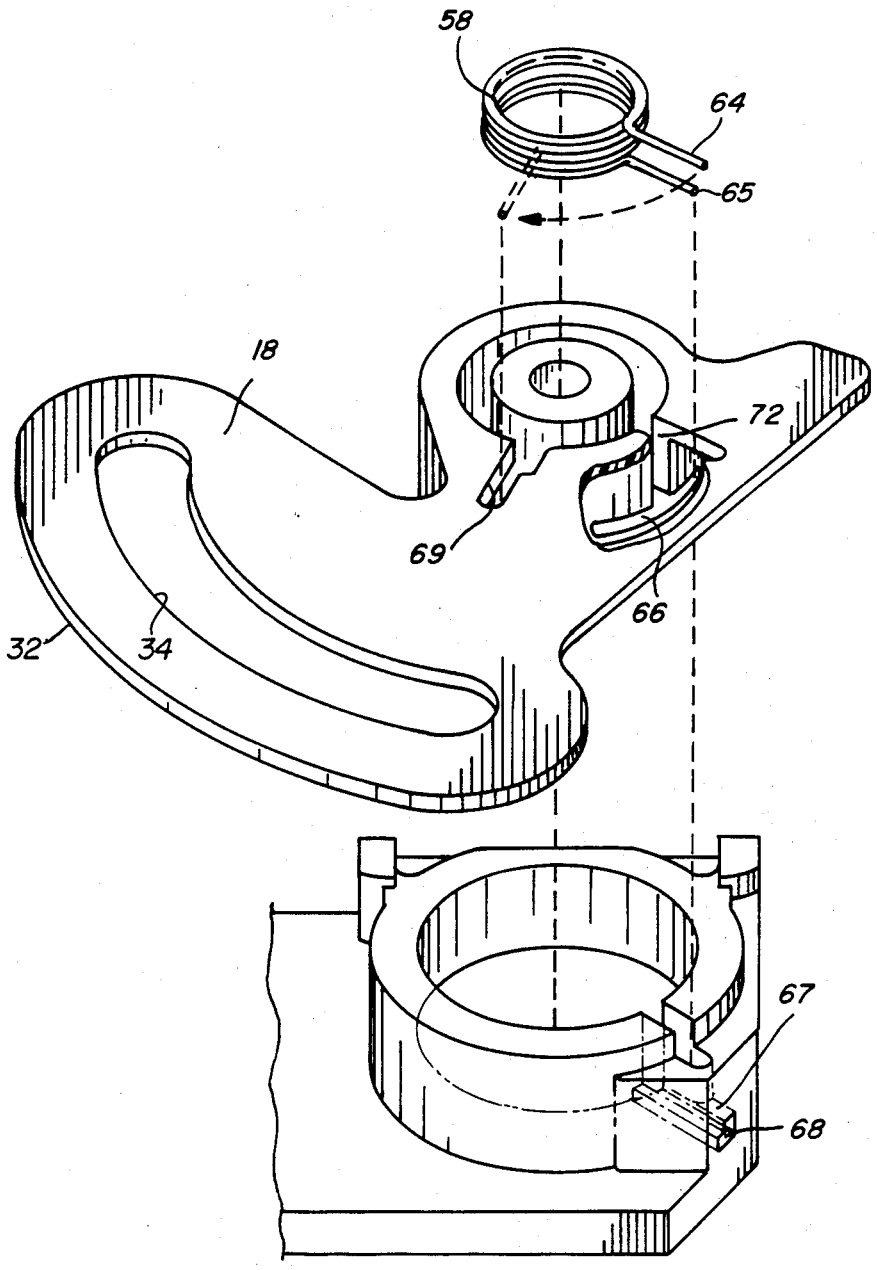
FIG. 4 is a partial view of the spring holding arrangement utilized in the present invention.

In the anchoring system for the ends 64,65 for the assembled switch mechanism, the lower end 65 extends through a radial slot 66 (FIG. 4) in actuator 18 and into a slot 67 formed in the section 16 of the body member 12 extending radially relative to the axis 40. The slot 67 extends slightly circumferentially relative to the axis 40 to form a generally L-shape opening having an upper surface 68 against which the end 65 is resiliently urged at final assembly of the switch mechanism. The upper end 64 of the spring 58 is held in a slot 69 formed in the actuator 18 and extending radially relative to the axis 40. As was the case with the end 65, the slot 69 is formed slightly circumferentially relative to the axis 40 to form a generally L-shape opening having a lower surface 70 against which the end 64 is resiliently urged. The upper surface 68 and the lower surface 70 are in parallel planes and extend toward each other.

During the assembly of the switch mechanism, a radial slot 72 (FIGS. 1 and 2), which is formed in the actuator 18 to communicate at its lower end with slot 66, is aligned with the slot 67 formed in the body member 12. This can be accomplished by rotating the actuator clockwise about the axis 40 as viewed in FIG. 1. In that position of the parts, the lower end section 65 of the spring 58 is inserted through both slots 67, 72. The axial relationship of the end 65 relative to the end 64 is such that with the end 65 at the bottom of the slot 67, the upper end section 64 of the spring would normally be positioned above the section 65 and slot 72. However, to complete the assembling procedure, the upper end 65 is moved over to the slot 69 and inserted therein while the actuator 18 is still held. Each of the end sections 64, 65 in the final assembly of the switch mechanism is in its respective L-shape opening associated with the slots 69 and 67. This action imposes a torsional force on the spring since the end sections are circumferentially spaced, as shown in FIG. 1.

With the spring 68 positioned as shown and under torsional bias, the end sections 64, 65 have a tendency to come together thereby imposing a corresponding resilient bias upon the actuator 18 causing the same to rotate in the direction of the arrow 74, as shown in FIG. 1. A suitable stop 75 is devised to limit the extent of rotation of the actuator in this direction. For purposes of illustration, the switch mechanism is arranged so that the switching element 46 is normally out of contact with the contact plate 26, thereby placing the switch mechanism in its open condition. The arrangement of the spring 58 and its mounting in the slots 67, 69 under the conditions described above, is such that the bias of the spring will force the element 46 out of contact with the plate 26 and the door lock mechanism 36 must be actuated to rotate the actuator 18 in a clockwise direction and increase this bias to effect contacting of the element 46 with the plate 26 and placing the switch mechanism into its closed position.

The coil spring 58 in its dual function also serves as the only means for holding these parts together. Upon removal of the spring, the actuator 18 may be lifted off the body member and the switch mechanism may be disassembled.

From the foregoing, it will be apparent that the present invention provides a switch mechanism which is adapted to convert external rotary switching actuation to rotary switch element movement utilizing a minimum of parts. The parts of the switch mechanism have been devised and arranged to that maximum utilization and efficiency are achieved using inexpensive parts and without sacrificing dependability and safety. For example, a single sealing device is needed to completely seal the critical space surrounding the switching elements. The O-ring type of sealing device for this purpose is perhaps the most dependable sealing expedient in use today, and the parts of the disclosed invention are arranged to accommodate its use. In this manner, condensation, dust and contaminants are prevented from invading the interior of the switch mechanism using a very low cost but very dependable means. Another example is the use of a single component, a coil spring, to accomplish a dual purpose to provide torque to a switch actuator and to retain the same in its assembled condition.

While this invention has been illustrated and described in detail in connection with a particular embodiment, it will be understood that other embodiments may be devised for which the concept of the invention can be applied,and that any modifications are intended to be covered as well being in the scope of one skilled in the art or the appended claims.

What is claimed is:

1. A switching mechanism for providing an electrical connection between two conductors associated therewith comprising a body member having a first contact element mounted thereon and connected to one of the conductors, and a second contact element mounted thereon spaced from said first contact element and being connected to the other conductor, an actuator member rotatably mounted on said body member and having a switching element connected thereto and rotatably movable therewith, said actuator member being movable to a first position wherein said movable switching element is out of electrical contact with said contact elements and to a second position wherein said movable switching element is in electrical contact with said contact elements, and a spring member associated with said actuator and arranged to resiliently bias the same to one of said positions, said body member and said actuator each having means for holding a portion of said spring member, respectively, for retaining said actuator on said body member.

2. The switching mechanism of claim 1 wherein said spring member is a coil spring having one end retained in said holding means of said body member and another end retained in said holding means of said actuator.

3. The switching mechanism of claim 2 wherein said contact elements are planar in shape and lie in approximately the same plane.

4. The switching mechanism of claim 3 wherein said movable switching element is arranged to slidably engage said first and second contact elements when rotatably moved.

5. A switching mechanism for providing an electrical connection between two conductors associated therewith comprising a body member having a first fixed contact plate mounted thereon and connected to one of the conductors, and a second fixed contact plate mounted thereon spaced from said first contact plate and being connected to the other conductor, an actuator member rotatably mounted on said body member and having a switching element connected thereto and rotatably movable therewith, said actuator member being movable to a first position wherein said switching element is out of electrical contact with said contact plates and to a second position wherein said element is in electrical contact with said plates, and a spring member associated with said actuator and arranged to resiliently bias the same to one of said positions, said body member and said actuator each having means for holding a portion of said spring member, respectively, for retaining said actuator on said body member.

6. The switching mechanism of claim 5 wherein said spring member is a coil spring having one end retained in said holding means of said body member and another end retained in said holding means of said actuator.

7. The switching mechanism of claim 5 wherein said movable switching element is arranged to slidably engage said first and second contact elements when rotatably moved.

8. A switching mechanism for providing an electrical connection between two conductors associated therewith comprising a body member having a first contact element mounted thereon and connected to one of the conductors, and a second contact element mounted thereon spaced from said first contact element and being connected to the other conductor, an actuator member rotatably mounted on said body member and having a switching element connected thereto and rotatably movable therewith, said actuator member being movable to a first position wherein said movable element is out of electrical contact with said contact elements and to a second position wherein said movable switching element is in electrical contact with said contact elements, and means connected to said boy member and said actuator and arranged to urge said actuator toward one of said positions and for holding the same on said body member.

9. The switching mechanism of claim 8 wherein said means is a coil spring having one end retained in said body member and another end retained in said actuator.

* * * * *